United States Patent [19]

Olmr

[11] 3,945,288

[45] Mar. 23, 1976

[54] SAW CHAIN

[75] Inventor: Jaroslav Jiri Olmr, Columbia, S.C.

[73] Assignee: Textron Inc., Providence, R.I.

[22] Filed: Apr. 25, 1975

[21] Appl. No.: 571,574

[52] U.S. Cl. ..... 83/834; 83/830

[51] Int. Cl.[2] ..... B27B 33/14

[58] Field of Search ..... 83/834, 830, 831, 832, 83/833

[56] References Cited

UNITED STATES PATENTS 3,224,476 12/1965 Chadwick ..... 83/834

*Primary Examiner*—Frank T. Yost

*Attorney, Agent, or Firm*—Webb, Burden, Robinson & Webb

[57] ABSTRACT

The bi-directional saw chain is made up of two links, a cutting link and a connecting link. The cutting link is symmetrical about its vertical center line and includes an L-shaped cutting section having cutting surfaces along both the leading and trailing edges. Legs extend outwardly from the cutting link on either side of the cutting section. These legs terminate in a surface which acts as a depth gauge. Each leg also includes a stop shoulder for engagement with the connecting link. The connecting link includes two offset and parallel sections, each having an outwardly extending flange. The outwardly extending flanges of adjacent connecting links form side by side parallel and spaced flanges which accommodate a perimetric trackway on the saw blade. Each connection is pivotal so that the leading leg acts as the depth gauge and the trailing leg engages the connecting link to form the stop and position the cutting link for proper functioning.

10 Claims, 11 Drawing Figures

SAW CHAIN

FIELD OF THE INVENTION

My invention relates to saw chains and, more particularly, to saw chains having bi-directional cutting links.

DESCRIPTION OF THE PRIOR ART

The basic saw chain employed today is made up of three basic links connected together serially to form an endless chain. The cutting link includes a generally L-shaped leading edge cutting surface and a forwardly positioned depth gauge to engage the bottom of the saw kerf to control the depth of the cut made by the cutting surface and prevent undue digging of the cutting link. In addition to the cutting link, a connecting link and a drive link are used. The drive link includes an outwardly extending flange and is centrally positioned along the longitudinal center line of the saw chain to ride in a groove in the saw blade. The remaining link is a standard connecting link or side link as it is called since it is generally used in pairs to connect the drive links or used singly in side by side relationship with a cutting link. Each of the links are pivotally connected to adjacent links and the saw chain is operable in a single direction.

A few bi-directional saw chains are known in the prior art, but these are made up of a series of complex links and/or components and for this reason have not proved practical or successful.

SUMMARY OF THE INVENTION

My saw chain provides a bi-directional cutting link so that the saw chain is totally reversible. The reversibility of the saw chain is achieved with a minimum number of links with each link being noncomplex in design. Because of the simplicity of design, my saw chain can be operated in a first direction, thereafter reversed and operated in a second direction and thereafter discarded and replaced by an identical saw chain. This avoids the necessity of sharpening since the noncomplex design results in an ease of manufacturing and resultant lower cost which permits the blade to be replaced at an expense favorable to repeated sharpening.

In accordance with the present invention the saw chain is made up of a cutting link and a connecting link. The cutting link has a central section substantially L-shaped having cutting surfaces along both the leading and trailing edges. Legs extend outwardly on either side of the cutting section. The leading leg serves as a depth gauge and the trailing leg functions as a positioning stop for cooperation with the connecting link. The connecting link includes two parallel and offset sections joined through an intermediate section and each having an outwardly extending flange. When the links are connected through pivotal connections, the outwardly extending flanges of adjacent connecting links form side by side, parallel and spaced flanges to accommodate a perimetrical trackway on the saw blade.

DESCRIPTION OF THE PREFERRED EMBODIMENTS

Figure 1:
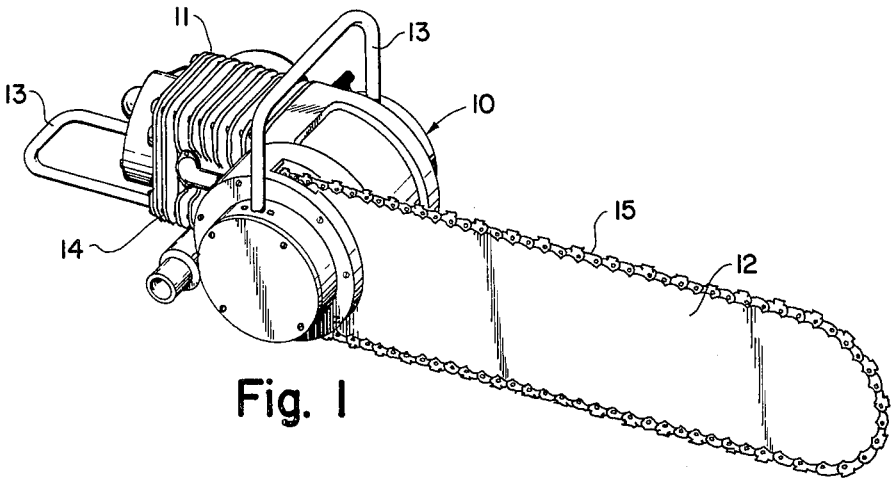
FIG. 1 is a pictorial representation of a chain saw.

My saw chain is intended for use on a chain saw, normally of the portable type and the details of which do not form a part of my invention. Such a chain saw, generally designated 10, includes a power providing means 11, a blade 12 and an endless saw chain 15 which is operative about the blade 12, FIG. 1. Handles 13 are normally provided about the power providing means 11 which is commonly an internal combustion engine 14. The saw chain is driven by a sprocket (not shown) within the power providing means housing and which in turn is driven by the output shaft of the engine 14.

Figure 2:
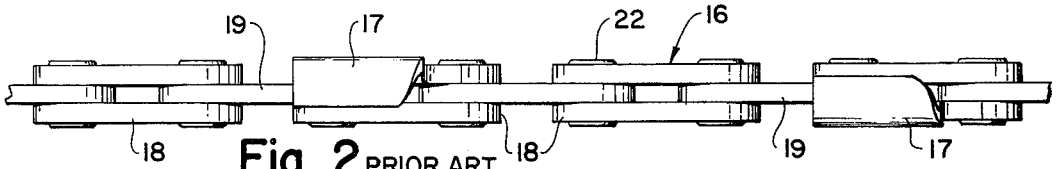
Fig. 2 PRIOR ART
FIG. 2 is a plan view of a prior art saw chain.
Figure 3:
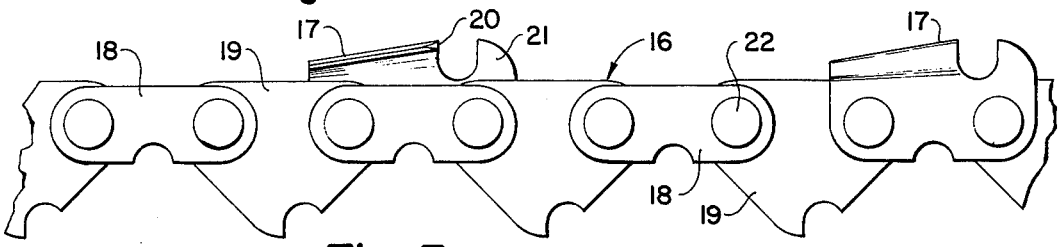
Fig. 3 PRIOR ART
FIG. 3 is an elevation of the prior art saw chain.

The prior art saw chain 16 for such chain saws 10 normally comprises a cutting link 17, side links 18 and a central drive link 19, FIGS. 2 and 3. The cutting link 17 has a cutting surface 20 along its leading edge and a depth gauge 21 in advance of the cutting surface 20 to control the depth of the cut. The links are joined by pivot pins 22. The assembled linkage normally includes a cutting link 17 and side link 18 in side by side relationship connected to a central drive link 19 which in turn is connected to side links 18 in side by side relationship. The side links 18 are then connected to a central drive link 19 which in turn is connected to the next cutting link 17, etc. The cutting link 17 is generally L-shaped and the cutting links 17 are alternately positioned on opposing sides of the saw chain 16.

Figure 4:
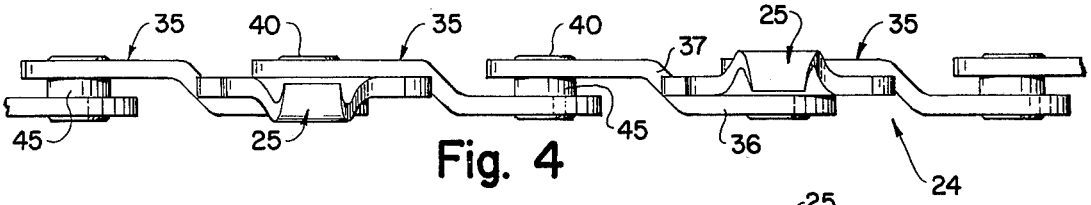
FIG. 4 is a plan view of the bi-directional saw chain.
Figure 5:
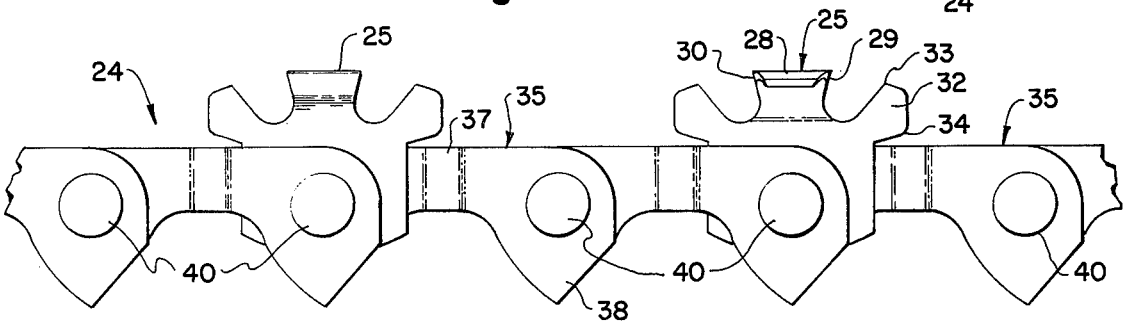
FIG. 5 is an elevation of the bi-directional saw chain.

My bi-directional saw chain, generally designated 24, is comprised of a cutting link 25 and a connecting link 35 joined by a pivot pin 40, FIGS. 4 and 5.

Figure 8:
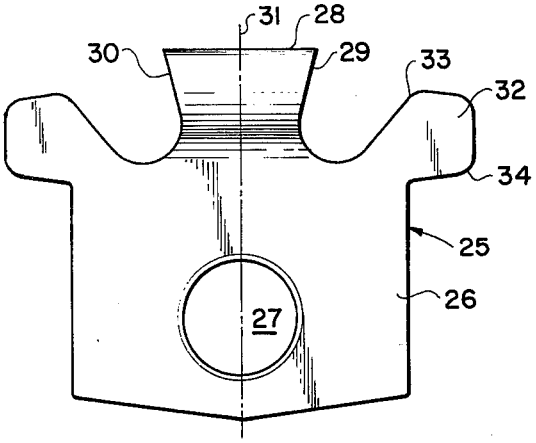
FIG. 8 is an elevation of the cutting link.
Figure 9:
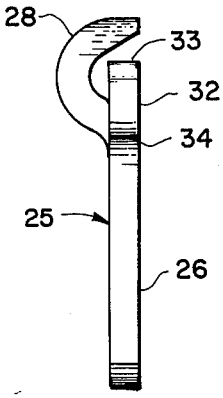
FIG. 9 is an end view of the cutting link.

The cutting link 25 comprises a main body 26 having a hole 27 therethrough to accommodate the pivot pin 40, FIGS. 8 and 9. Extending outward from the body 26 is the cutting section 28, generally L-shaped. Cutting section 28 initially extends outward in a plane laterally angular to the body 26 and then reverse turns and terminates substantially in and above the plane of the body 26. The cutting section 28 has leading cutting edges 29 and trailing cutting edges 30. The cutting section 28 and the cutting link 25 itself is symmetrical about a vertical center line 31 so as to permit the saw chain 24 to be used in either direction.

Also extending outward from the body 26 of the cutting link 25 are legs 32, FIGS. 8 and 9. These legs 32 extend outward at an angle to and in the same plane as the body 26 and on either side of the cutting section 28. Each leg 32 forms at its distal end a depth gauge 33. Opposite the depth gauge 33 on leg 32 is shoulder 34 which is substantially adjacent the body 26. Shoulder 34 acts as a positioning stop as will be described hereinafter.

Figure 6:
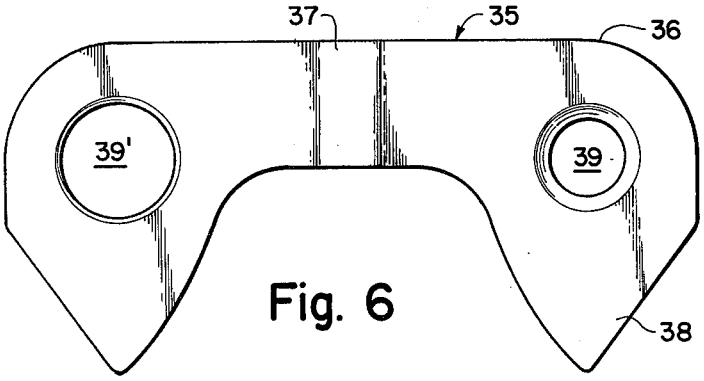
FIG. 6 is an elevation of the connecting link.
Figure 7:
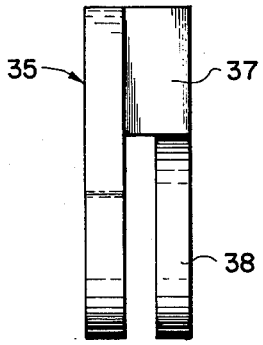
FIG. 7 is an end view of the connecting link.
Figure 11:
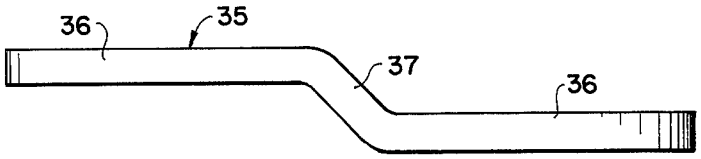
FIG. 11 is a plan view of the connecting link.

The connecting link 35 is comprised of two connecting link sections 36 which are parallel and offset from each other and connected through an intermediate connecting section 37 which is angularly displaced with respect to both sections 36, FIGS. 6, 7 and 11. Each connecting link section 36 has an outwardly extending flange 38 which is gradually tapered to terminate in a point, FIG. 6. Each connecting link 35 also has a connecting link section 36 with a hole 39' of substantially the same diameter as hole 27 of the cutting link 25 and a cutting link section 36 with a hole 39 slightly smaller in diameter.

Figure 10:
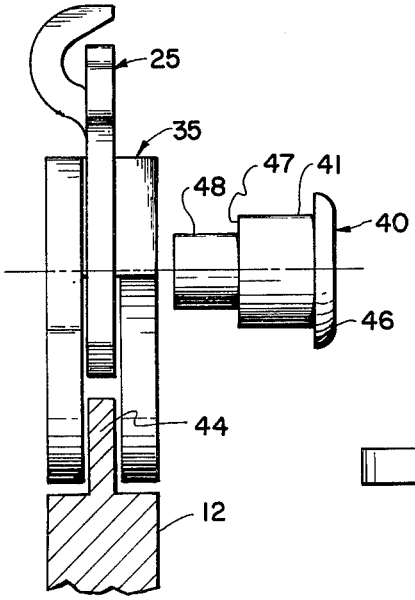
FIG. 10 is a partly exploded view showing the links in assembled condition and about the blade.

The connecting links 35 and the cutting links 25 are pivotally joined by a rivet 40, FIG. 10. Rivet 40 has a head 46, an intermediate section 41 smaller than the head 46 and terminating in a shoulder 47 and a smaller diameter terminal shank 48 extending from intermediate section 41.

Each connecting link 35 is pivotably joined by pin or rivet 40 at one end to an adjoining connecting link 35 and at the other end to a cutting link 25 and a connecting link 35. Specifically, the connecting link section 36 having the larger hole 39' is positioned in alignment with the hole 27 of the cutting link 25. The holes 39' and 27 accommodate the enlarged intermediate section 41 of the rivet 40. The connecting link section 36 with the smaller hole 39 of an adjacent link 35 is positioned in alignment so that the smaller hole 39 accommodates the terminal shank 48 of rivet 40, FIGS. 4, 5 and 10.

The connecting link section 36, not connected to the cutting link 25, is connected to an adjacent connecting link 35, FIGS. 4 and 5. In this connection an identical rivet 40 is used and the intermediate section 41 accommodates the large hole 39' of one of the links and the terminal shank section 48 accommodates the smaller hole 39 of the adjacent connecting link. A spacer 45 is employed between the respective connecting links to maintain the proper spacing as the saw chain 24 moves about the blade 12, thereby avoiding any binding in the area of the socket (not shown).

Flanges 38 of adjacent connecting links 35 are therefore positioned in parallel, spaced and side by side relationship with adjacent flanges 38 whether the connection includes the cutting link 25 or not. In other words, the connecting links themselves constitute an endless chain and the cutting links 36 are appropriately positioned along the length of the chain.

The blade 12 includes a perimetrical trackway 44 which accommodates the spaced flanges 38 which ride thereover during operation, FIG. 10. The trackway 44 is a flange extending outwardly along the longitudinal center line of the blade. The flange is dimensioned with respect to the flanges 38 of the connecting links 35 so as to permit free pivotal movement of the cutting link 25 as described hereinafter.

The operation of my saw chain is as follows. The cutting links 25 and connecting links 35 are serially connected as described hereinabove so as to form an endless chain. The cutting links 25 are alternately positioned on opposing sides of the chain, FIGS. 4 and 5. The side by side spaced flanges 38 of respective connecting links 35 are positioned so as to accommodate the trackway 44 of the blade 12. The chain extends around the sprocket (not shown) which is driven by the power assembly of the chain saw. As the leading cutting edge 29 of the cutting link 25 is engaging the wood, the shoulder 34 on the trailing leg 32 is abutting against the intermediate joining section 37 of connecting link 35 so as to properly position and retain the cutting edge 29 in cutting position. When the saw chain 24 is reversed so that the trailing cutting edge 30 becomes the leading cutting edge, the leg 32 which originally acted as the depth gauge now acts as the stop as its shoulder 34 engages the connecting section 37 of connecting link 35.

Because of the few number of components and the simplicity of the parts, the saw chain is generally used, reversed and then discarded in favor of a new saw chain.

I claim:

1. A saw chain made up of a series of pivotally connected links including a plurality of bi-directional cutting links and a plurality of connecting links pivotally connected to and extending outward from opposing ends of each cutting link, each cutting link having an L-shaped cutting element with cutting edges along both the leading and trailing edges and legs extending angularly outward on opposite sides of the cutting element and each terminating in a depth gauge at its distal end and including a stop shoulder adapted for engagement with the connecting link.

2. The saw chain in claim 1 wherein each connecting link comprises two offset and parallel sections joined by a connecting section adapted for engagement with the stop shoulder of the cutting link.

3. The saw chain of claim 2 wherein each offset section includes an opening therethrough to accommodate a pivot pin and an outwardly extending flange which forms side by side parallel and spaced flanges with adjacent links to accommodate a trackway of a saw blade.

4. In a chain saw having a blade with a perimetrical trackway, the improvement comprising a saw chain made up of two basic links, the first link being a bi-directional cutting link having an L-shaped cutting section with cutting surfaces on both leading and trailing edges and a leg extending outward on opposite sides of the cutting section to form a depth gauge at the distal end thereof and a stop substantially adjacent the cutting section, the second link being a connecting link having two offset and parallel sections joined by a connecting section adapted for engagement with the cutting link stop, each offset section having an outwardly extending flange, said links being pivotally connected so that the connecting sections define side by side parallel and spaced flanges which accommodate the perimetrical trackway.

5. The improvement of claim 4, wherein the connecting links are pivotally and serially connected to form an endless chain and the cutting links are spaced along the endless chain.

6. The improvement of claim 5 wherein the cutting link forms a spacer for the flanges of certain adjacent connecting links and a spacer means is positioned between a remainder of the flanges of adjacent connecting links.

7. The improvement of claim 4 wherein the cutting link is symmetrical about a vertical center line and the direction of the L-shaped cutting section is opposingly alternated along the chain.

8. A saw chain made up of a series of connecting links pivotally connected by pins to form an endless chain and cutting links pivotally spaced along the endless chain, each connecting link including two offset and parallel sections joined by an intermediate section angularly disposed therebetween, each offset section including a hole therethrough to accommodate the pivot pin and an outwardly extending flange, said connecting links formed so that offset sections of adjacent links are positioned in spaced, parallel and side by side relationship.

9. The saw chain of claim 7, wherein the cutting link includes an apertured body having an L-shaped cutting section with cutting surfaces on both leading and trailing edges thereof and legs extending outward from the body on opposite sides of the cutting section, each leg having a distal end which forms a depth gauge and a shoulder portion substantially adjacent the body adapted to engage the intermediate section of the connecting link, said cutting link being symmetrical about a vertical center line and being positioned between adjacent spaced connecting links on a pivot pin.

10. A bi-directional saw chain cutting link symmetrical about a vertical center line and comprising:

A. a perforated base portion to accommodate a pivot pin;

B. two legs extending angularly outwardly from opposite ends of the base portion in substantial planar relationship therewith, each leg terminating in a depth gauge at its distal end and including a stop shoulder on a surface opposite from the distal end and substantially adjacent the base portion; and C. an L-shaped cutting element extending outward from the base portion along the vertical center line and between the legs, the cutting element having cutting edges along both the leading and trailing edges.

* * * * *